United States Patent [19]

Boda

[11] Patent Number: 4,927,216

[45] Date of Patent: May 22, 1990

[54] SIDE MOUNTED DRAWER SLIDE SYSTEM

[75] Inventor: John W. Boda, Roscoe, Ill.

[73] Assignee: Amerock Corporation, Rockford, Ill.

[21] Appl. No.: 371,505

[22] Filed: Jun. 26, 1989

[51] Int. Cl.[5] ..... A47B 88/00

[52] U.S. Cl. ..... 312/339; 312/341.1; 384/19

[58] Field of Search ..... 312/311 R, 334, 339, 312/341.1, 330 R; 384/17, 18, 19, 20

[56] References Cited

U.S. PATENT DOCUMENTS 3,701,577 10/1972 Fischer ..... 312/339
4,121,876 10/1978 Ratti ..... 308/3.8

FOREIGN PATENT DOCUMENTS 0060180 11/1947 Netherlands ..... 312/339

*Primary Examiner*—Kenneth J. Dorner
*Assistant Examiner*—Gerald Anderson
*Attorney, Agent, or Firm*—Leydig, Voit & Mayer

[57] ABSTRACT

A drawer slide system of the type in which a rail is supported on each side of a drawer and coacts with an adjacent cabinet-mounted track to support the drawer for back and forth horizontal movement in the cabinet. The rail and track may either be used alone in a conventional slide system or the same rail and track may be used in conjunction with an intermediate adaptor in a fully extendible slide system.

10 Claims, 5 Drawing Sheets

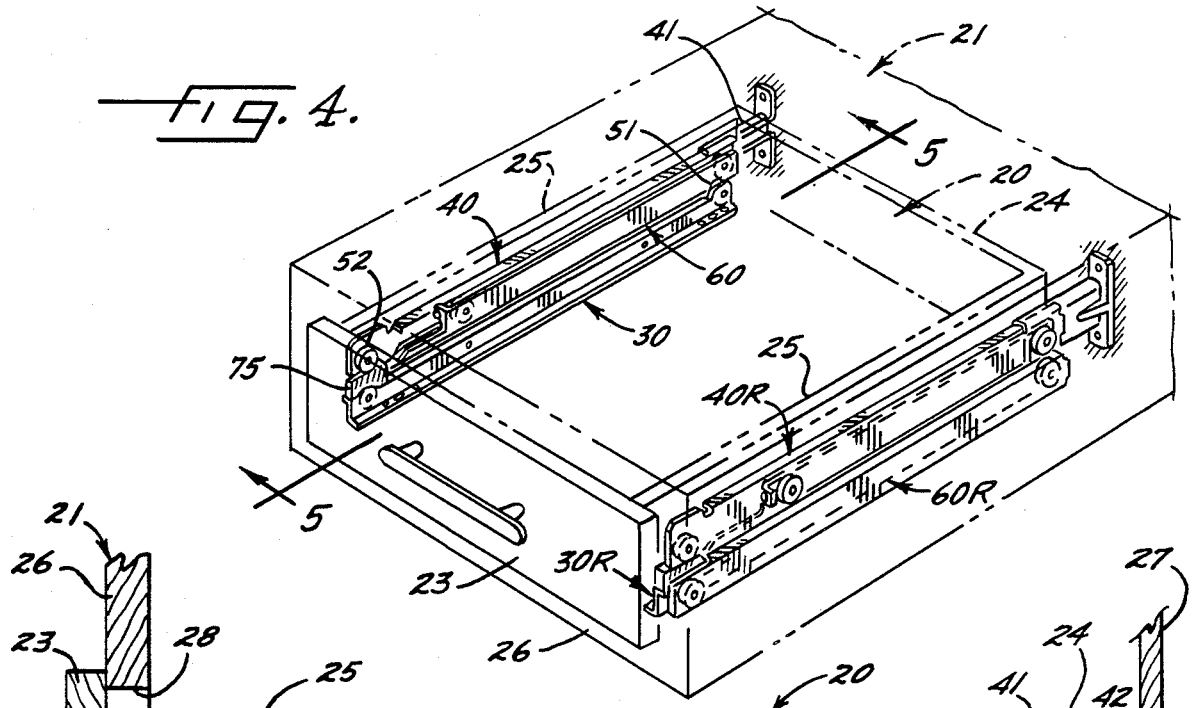
Fig. 4.
Fig. 5.
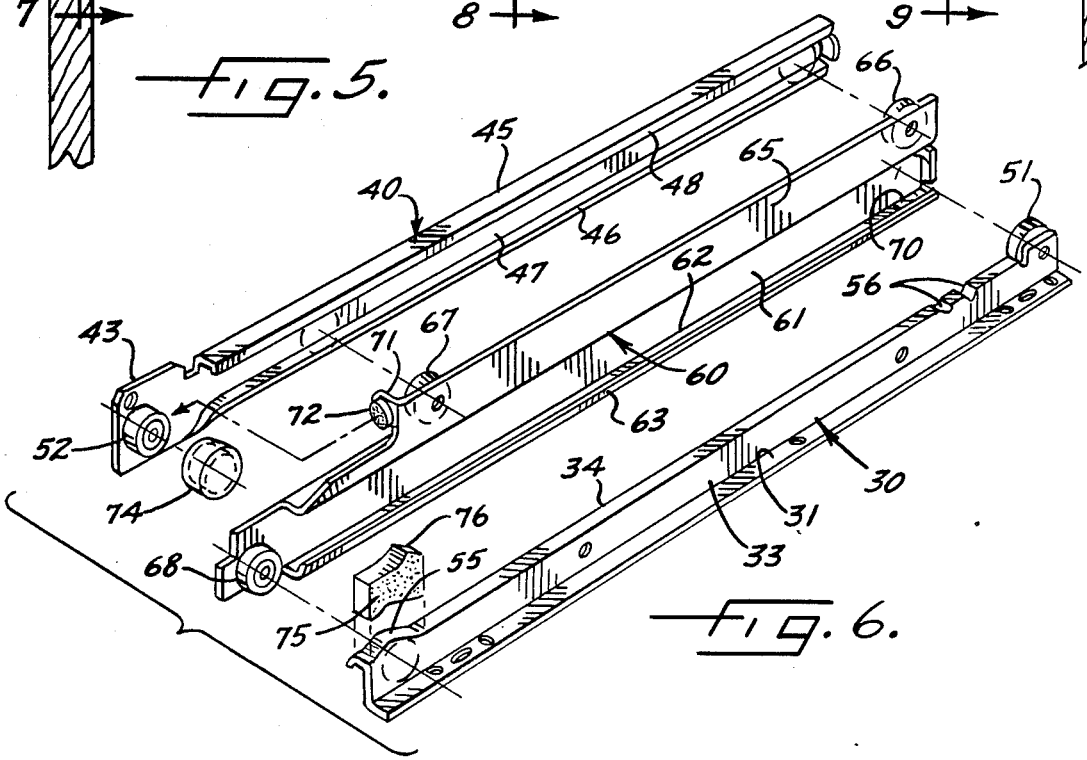
Fig. 6.

SIDE MOUNTED DRAWER SLIDE SYSTEM

BACKGROUND OF THE INVENTION

This invention relates generally to systems for supporting a drawer in a cabinet for back and forth horizontal movement between closed and open positions. More particularly, the invention relates to drawer slide systems of the type in which the drawer is supported by track and rail assemblies located along the two sides of the drawer.

One of the more simple and economical side-mount drawer slide systems may be referred to as being a two-component system in that only two primary components are located along each side of the drawer. In such a system, an elongated rail is secured to and extends along the side of the drawer while an elongated track extends alongside the rail and is secured to the cabinet. As the drawer is opened and closed, a roller carried by the rear end portion of the rail rides along the track. At the same time, the rail rides along a roller which is rotatably supported by the front end portion of the track.

Although a two-component system is simple and economical, it does not permit the drawer to be completely extended when the drawer is in fully open position. That is to say, the rear end portion of the drawer remains in the cabinet when the drawer has been opened to its maximum extent. Thus, the contents in the rear end portion of the drawer are not fully visible or accessible.

To overcome this drawback, three-component drawer slide systems have been devised and enable full extension of the drawer to a position in which the rear end of the drawer is in close proximity to and, in some cases, spaced forwardly of the front of the cabinet. In a typical three-component system, an intermediate member with rollers is interposed between the rail and the track. When the drawer is first opened, the rail and the intermediate member initially move in unison relative to the track to enable partial extension of the drawer. Movement of the intermediate member is stopped after the front end of the intermediate member has been extended beyond the front of the cabinet. Thereafter, the rail moves relative to and is supported by the intermediate member to permit opening of the drawer to a fully extended position.

Many cabinet makers build cabinets both with two-component systems and with three-component systems. Also, typical drawers range in length from 12 inches to 24 inches. In prior art systems, the rails and tracks of two-component systems are constructed differently from those of three-component systems. Also, some prior three-component systems require intermediate members of different lengths for different lengths of drawers. As a result, cabinet makers have been forced to carry a relatively large inventory of different rails, tracks and intermediate members in order to provide either a two-component system or a three-component system and to accommodate drawers of different lengths. In addition, the manufacturer of the drawer slide components incurs relatively high costs in providing tools for making the different types of components.

SUMMARY OF THE INVENTION

The general aim of the present invention is to provide a new and improved drawer slide system in which the rail and track components may be used universally in either a two-component system or in a three-component system.

Another object of the invention is to provide a three-component system having an intermediate member in the form of a unique adaptor which may be used universally with drawers having lengths varying within a wide range of lengths.

A more detailed object of the invention is to use the supporting roller on the track of a two-component system as a full-open stop when the track is used in a three-component system. The roller also is used to help hold the drawer releasably in its fully closed position and to help center the drawer laterally when the track is used in a three-component system.

The invention also resides in the provision of novel means for laterally confining the adaptor of the three-component system.

These and other objects and advantages of the invention will become more apparent from the following detailed description when taken in conjunction with the accompanying drawings.

BRIEF DESCRIPTION OF THE DRAWINGS

FIG. 4 is a view similar to FIG. 1 but shows the drawer and cabinet equipped with the unique three-component system incorporating the unique features of the present invention.

FIG. 5 is an enlarged fragmentary cross-section taken substantially along the line 5—5 of FIG. 4 and shows the drawer in its fully closed position.

FIG. 6 is an exploded perspective view of the components for one side of the drawer shown in FIGS. 4 and 5.

DETAILED DESCRIPTION OF THE PREFERRED EMBODIMENT

Figure 1:
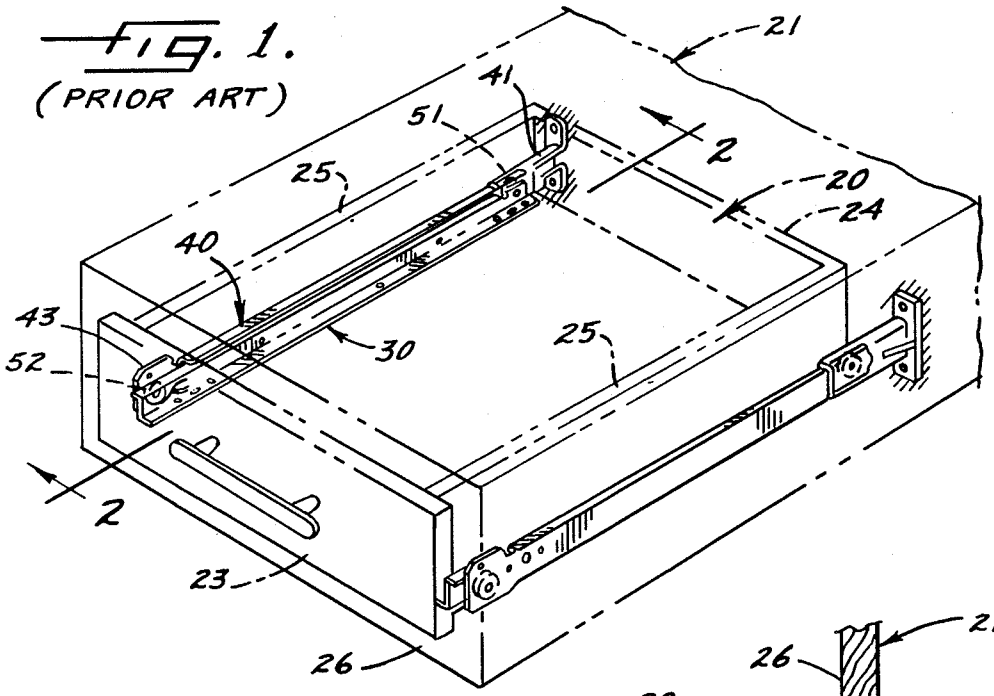
FIG. 1. (PRIOR ART)
FIG. 1 is a perspective view showing a drawer and cabinet equipped with a conventional rail and track of a typical two-component system, the drawer being shown in a fully closed position.
Figure 3:
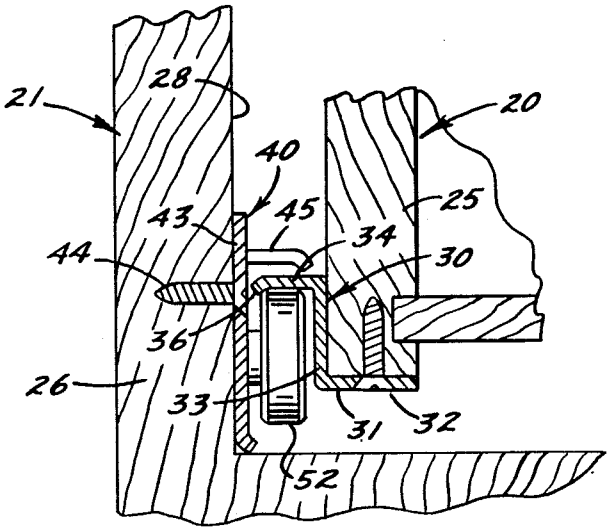
FIG. 3. (PRIOR ART)
FIG. 3 is an enlarged fragmentary cross-section taken substantially along the line 3—3 of FIG. 2.
Figure 2:
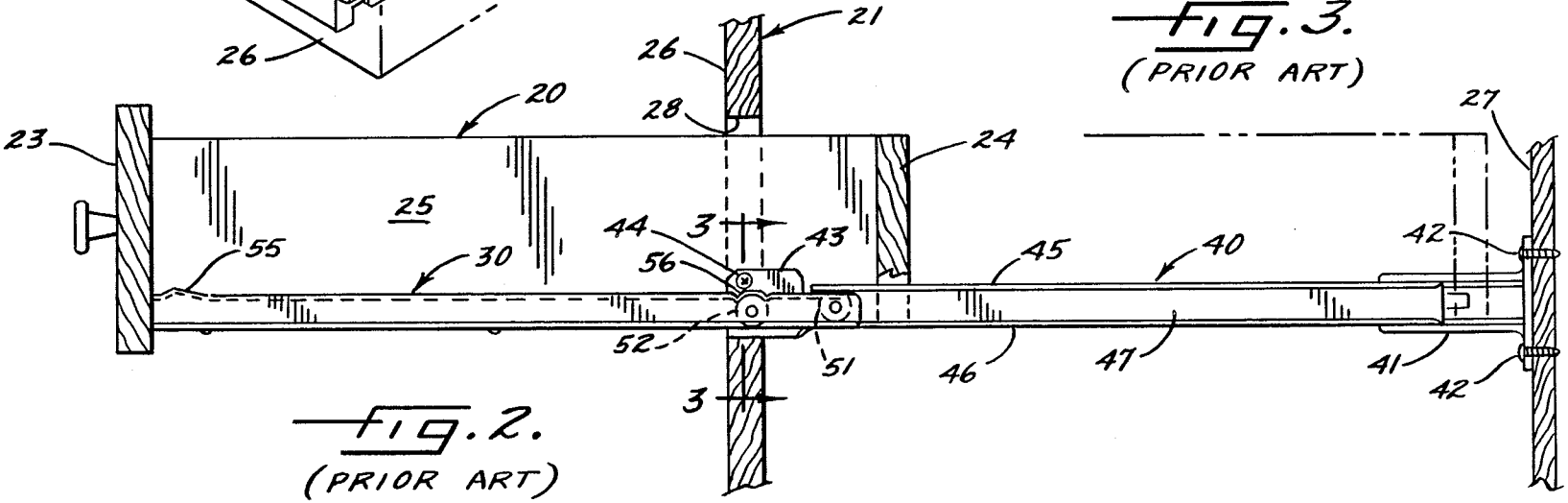
FIG. 2. (PRIOR ART)
FIG. 2 is an enlarged fragmentary cross-section taken substantially along the line 2—2 of FIG. 1 but shows the drawer in its fully open position.
Figure 7:
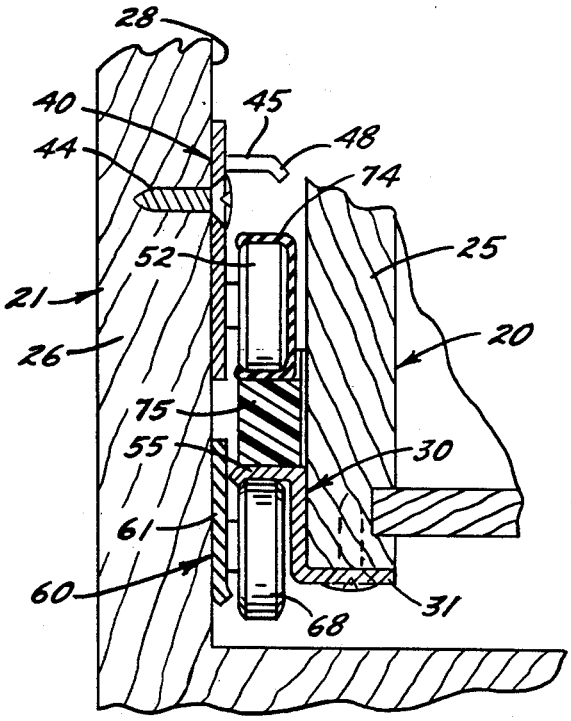
FIGS. 7, 8 and 9 are enlarged fragmentary cross-sections taken substantially along the lines 7—7, 8—8 and 9—9, respectively, of FIG. 5.
Figure 8:
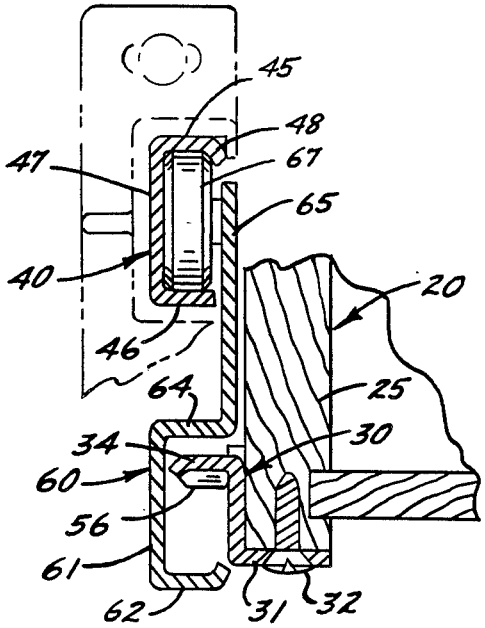
Figure 9:
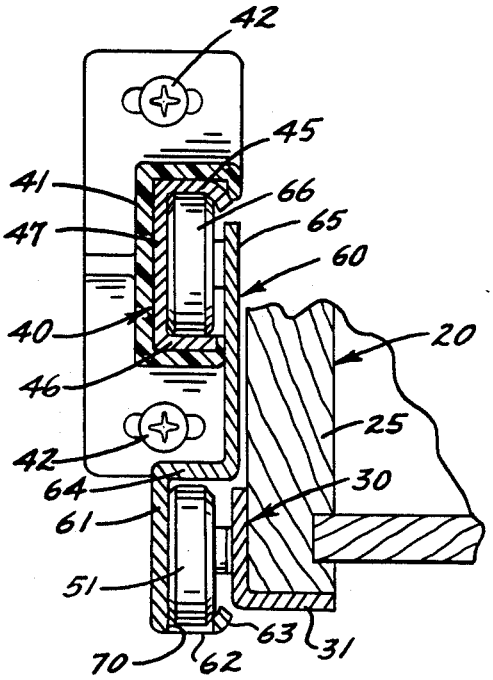
Figure 12:
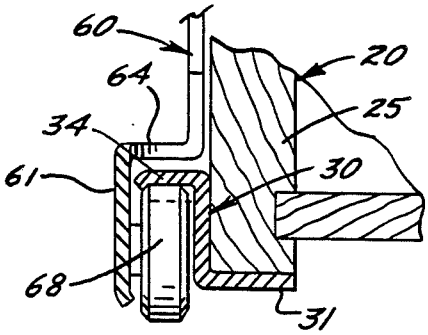
FIGS. 12 and 13 enlarged fragmentary cross-sections taken substantially along the lines 12—12 and 13—13, respectively, of FIG. 11.
Figure 13:
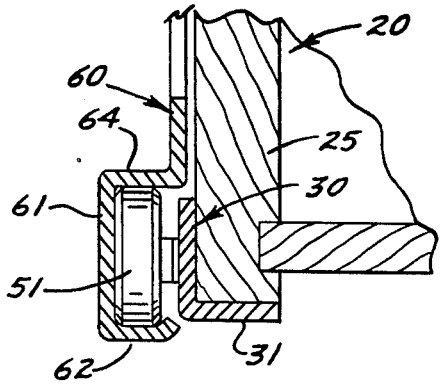

For purposes of explaining the drawer slide system of the invention, reference first is made to FIGS. 1 to 3 which show a conventional two-component system for mounting a drawer 20 for back and forth horizontal movement in a cabinet 21. The drawer 20 includes front and rear walls 23 and 24 and two side walls 25. The cabinet 21 has been shown as including front and rear walls 26 and 27 (FIG. 2), the front wall having an opening 28 therethrough for accommodating the drawer.

Components for supporting the drawer 20 are located adjacent each side of the drawer. Except for a difference to be discussed subsequently, the components at the left side of the drawer (when facing the front of the drawer) are mirror images of components at the right side of the drawer. For the time being, only the components on the left side of the drawer will be described, with the understanding that the right side components are generally similar.

The left side components include an elongated metal rail 30 which is secured to the drawer 20 and which extends along substantially the entire length of the left side wall 25 adjacent the bottom thereof. As shown in FIG. 3, the rail 30 is generally Z-shaped in cross-section and includes a flange 31 which is fastened to the lower edge of the side wall 25 by screws 32. A web 33 is formed integrally with and projects upwardly from the flange 31 and lies along the outer side of the side wall 25. Formed integrally with and projecting outwardly from the upper end of the web 33 is a flange 34 whose outer edge is turned downwardly as indicated at 36.

The second major component of the left side of the system of FIGS. 1 to 3 is a metal track 40 which is secured to the cabinet 21 and which is located just outboard of the rail 30. At its rear end, the track is telescoped into a plastic bracket 41 which is fastened to the rear wall 27 of the cabinet 21 by screws 42. The forward end of the track is formed with an integral mounting plate 43 which lies against the inner side of the opening 28 and which is fastened to the front 26 of the cabinet 21 by a screw 44 (FIG. 3).

The track 40 is generally C-shaped in cross-section and includes upper and lower flanges 45 and 46 (FIG. 6) formed integrally with the upper and lower ends, respectively, of a vertical web 47 and projecting inwardly toward the drawer 20. A downturned lip 48 is formed integrally with and extends along the length of the upper flange 45.

Received within the track 40 is a roller 51 which is rotatably supported by the rear end portion of the rail 30 to turn about a horizontal axis. A second roller 52 is rotatably supported to turn about a horizontal axis by the mounting plate 43 of the track 40 and serves as a support for the upper flange 34 of the rail 30.

With the foregoing arrangement, the roller 51 of the rail 30 rides back and forth in the track 40 in a substantially friction-free manner as the drawer 20 is pushed in and pulled out. During such movement, the upper flange 34 of the rail 30 rides along and is supported by the roller 52 of the track 40. When the drawer is in its fully closed position, a raised ramp 55 (FIG. 2) in the forward portion of the upper flange 34 of the rail 30 seats behind the roller 52 of the track 40 to releasably hold the drawer closed. When the drawer is opened to the position of FIG. 2, the roller 51 is received between two depressed dimples 56 in the upper flange 34 and thus the drawer is held releasably against opening further. By tilting the forward end portion of the drawer upwardly, the rail 30 may be released from the roller 52 to permit the drawer to be removed from the cabinet.

Lateral movement of the drawer 20 is restricted by virtue of the downturned edge 36 of the upper flange 34 of the rail 30 extending around and engaging the outboard side of the roller 52. In addition, the downturned lip 48 of the upper flange 45 of the track 40 extends around the inboard side of the roller 51 and coacts with the edge 36 to confine the drawer laterally and to keep the rollers 51 and 52 and the flanges 34, 45 and 46 in laterally centered relation.

The components at the right side of the drawer 20 of FIGS. 1 to 3 are similar to those at the left side except that the upper flange on the right side rail does not include a downturned edge corresponding to the edge 36 nor does the upper flange on the right side track include a downturned lip corresponding to the lip 48. Such omissions accommodate tolerance variations between the width of the drawer and the lateral spacing of the left and right side components and avoid the need for mounting the components with a high degree of dimensional precision.

As is apparent, only two major components (i.e., the rail 30 and the track 40) are required at each side of the drawer 20 of FIGS. 1 to 3. Thus, the drawer slide system shown therein is relatively simple and inexpensive. The system is limited, however, in that the drawer may be opened only to the position shown in FIG. 3 since there is inadequate forward support to permit further opening of the drawer. In the open position of FIG. 3, the rear wall 24 of the drawer is spaced well rearwardly of the front 26 of the cabinet 21 and thus contents in the rear portion of the drawer are concealed from clear view and are not readily accessible.

In accordance with the present invention, the same rail 30 and the same track 40 which are employed in the two-component system also are used in a three-component system (FIGS. 3 to 15) having the capability of permitting full extension of the drawer 20 to a position in which the rear 24 of the drawer is in close proximity to or is in front of the front 26 of the cabinet 21. Moreover, the third major component of the three-component system is an adaptor 60 which may be used universally with drawers of various lengths. As will become apparent subsequently, the use of the same rail 30 and track 40 in both two-component systems and three-component systems and the use of a universal adaptor 60 in three-component systems significantly reduces tooling and inventory requirements.

Figure 14:
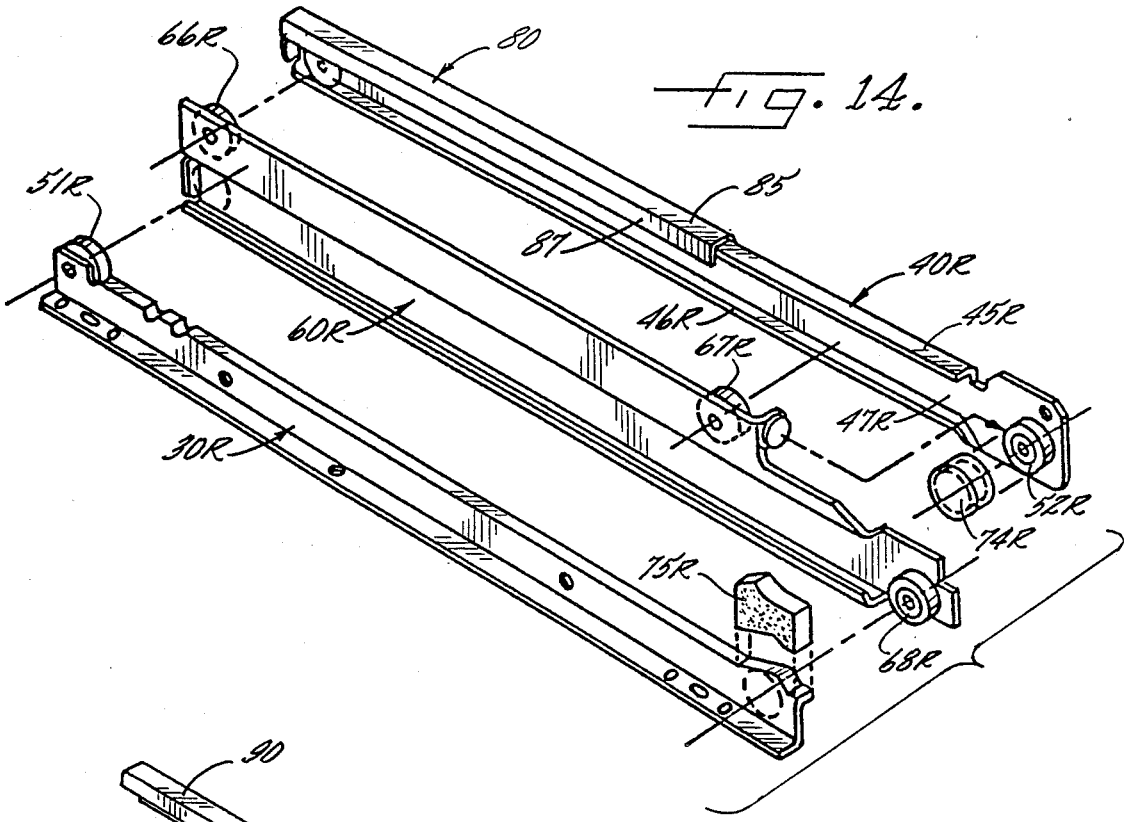
FIG. 14 is an exploded perspective view of the components for the other side of the drawer shown in FIGS. 4 and 5.
Figure 15:
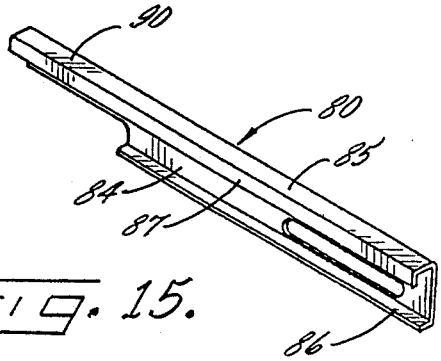
FIG. 15 is a perspective view of one of the parts shown in FIG. 14.

The three-component system of the invention has been illustrated in FIGS. 4 to 15 with the left side components being shown in FIGS. 5 to 13 and with the right side components being shown in FIGS. 14 and 15. As before, the left side components will be described first and then the right side components will be described.

In the three-component system, the rail 30 is mounted on the drawer 20 exactly as before. The track 40 also is secured to the cabinet 21 in the same way as described previously except, in the case of the three-component system, the track 40 is spaced above the rail 30 rather than being located at approximately the same elevation as the rail.

The adaptor 60 of the three-component system is an elongated sheet metal member which is interposed between the rail 30 and the track 40. As shown most clearly in FIG. 6, the adaptor includes an upright web 61 whose lower end is formed with an integral inwardly projecting flange 62. An upturned lip 63 (FIG. 8) is formed integrally with the inner margin of the flange 63.

A second inwardly projecting flange 64 (FIG. 8) is formed integrally with the upper end of the web 61 and coacts with the flange 62 to define a C-shaped channel which receives the roller 51 of the rail 30. A second web 65 (FIGS. 6 and 8) extends upwardly from the flange 64 and its outboard side carries two rollers 66 and 67 which are supported to rotate about horizontal axes and which are received in the track 40 between the flanges 45 and 46 thereof. The roller 66 is located at the rear end portion of the adaptor 60 while the roller 67 is located between the front and rear ends of the adaptor. Another roller 68 is supported to rotate about a horizontal axis by the inboard side of the forward end portion of the web 61 of the adaptor. The roller 68 is spaced below the rollers 66 and 67 and serves to support the flange 34 of the rail 30.

When the drawer 20 is fully closed as shown in FIG. 5, the roller 51 of the rail 30 seats in a rectangular opening or window 70 (FIGS. 6 and 7) which is formed in the rear end portion of the lower flange 62 of the adapter 60. As a result of such seating, the roller 51 causes the adaptor 60 to move forwardly in unison with the rail 30 when the drawer is first pulled open from its fully closed position. During such movement, the rollers 66 and 67 of the adaptor 60 roll within the track 40. And, by virtue of such movement, the adaptor 60 shifts forwardly to a position in which the forward end portion of the adaptor extends forwardly from the front 26 of the cabinet 21 (see FIG. 10). When the drawer 20 has been opened through approximately four inches to the intermediate position shown in FIG. 10, further forward movement of the adaptor 60 is stopped and, at this time, the roller 51 releases from the window 70 to permit the drawer to move forwardly independently of the adaptor. As the drawer moves forwardly relative to the stopped adaptor, the roller 51 of the rail 30 rides within the channel defined between the flanges 62 and 64 of the adaptor and, at the same time, the lower flange 31 of the rail rides along and is supported by the front roller 68 of the adaptor. Because such roller is located forwardly of the cabinet 21, it provides sufficient support to enable the drawer to be pulled to a fully extended position in which the rear wall 24 of the drawer is located approximately ¼ inch forwardly of the front 26 of the cabinet as shown in FIG. 11. When the drawer reaches that position, the dimples 56 engage the roller 68 to prevent further opening of the drawer.

When the drawer 20 is closed, the rail 30 moves rearwardly independently of the adaptor 60 until the roller 51 drops into the window 70 in the adaptor. At this time, further closing of the drawer causes the rail and the adaptor to move rearwardly in unison until the drawer is fully closed.

Figure 10:
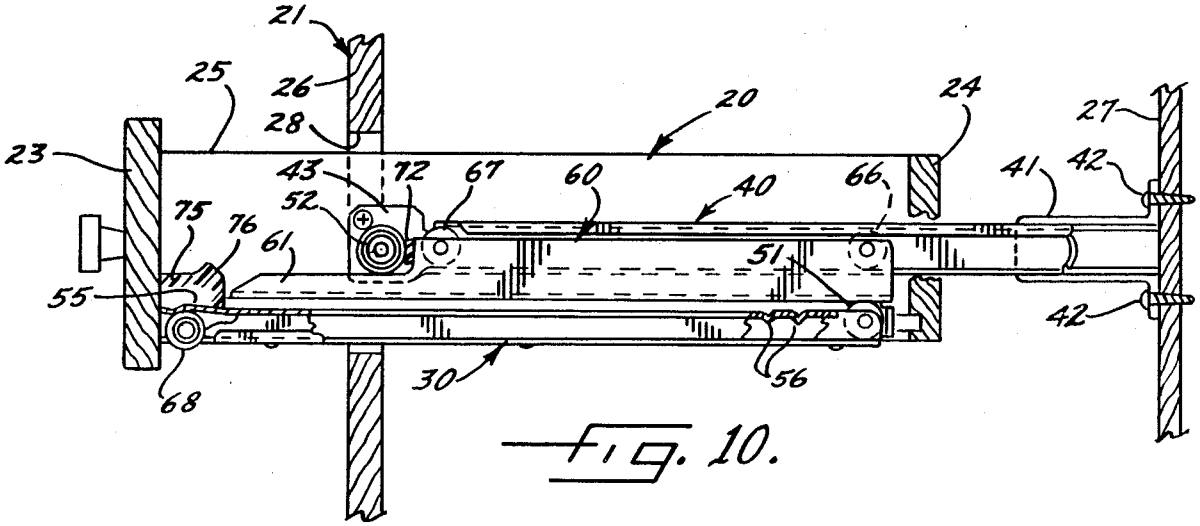
FIG. 10 is a view similar to FIG. 5 but shows the drawer in a partially open position.
Figure 11:
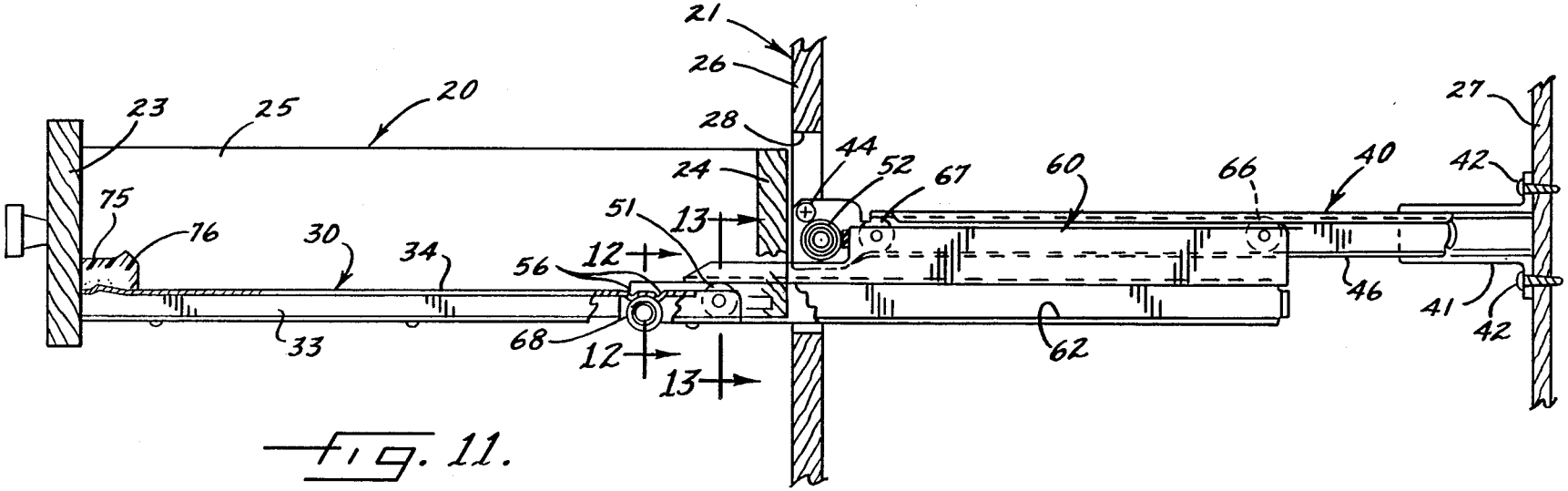
FIG. 11 is also a view similar to FIG. 5 but shows the draweropened to its fully extended position.

Advantageously, the roller 52 of the track 40 is used to stop forward movement of the adaptor 60 when the adaptor reaches the position of FIG. 10. For this purpose, a tab 71 (FIG. 6) is bent outwardly from the web 65 of the adaptor and carries a resiliently yieldable cushion 72 which is adhesively bonded to the tab. When the drawer 20 has been moved forwardly approximately four inches from its fully closed position, the cushion 72 on the tab 71 engages the rear side of the roller 52 of the track 40 to stop further forward movement of the adaptor.

The roller 52 of the track 40 also helps confine lateral movement of the drawer 20. To enhance the confining action of the roller 52, a plastic cup 74 (FIG. 6) may be snapped over the roller to increase its axial dimension. The cup 74 engages the side 25 of the drawer and helps confine the drawer laterally near the front 26 of the cabinet 21.

In addition to the functions previously mentioned, the roller 52 of the track 40 serves to hold the drawer 20 releasably in its fully closed position. To this end, a block 75 (FIGS. 6 and 7) of rubber or other resiliently yieldable material is adhesively secured to the side 25 of the drawer immediately above the ramp 55 at the forward end portion of the rail 30. A bumper 76 is formed integrally with and projects upwardly from the block and, when the drawer is fully closed, lies immediately behind the roller 52. Thus, the bumper 76 coacts with the roller 52 to produce a snubbing action for releasably keeping the drawer in a closed position.

The rail 30R, the track 40R and the adaptor 60R for the right side of the drawer 20 are shown in FIG. 14. The right side rail 30R and track 40R are identical to the right side components described previously for the two-component system while the right side adaptor 60R is a mirror image of the left side adaptor. Since the right side track 40R lacks a retaining lip on the upper flange 45R, means are adapted to be detachably fastened to the right hand track in order to form a lateral retainer for the roller 66R of the adaptor 60R. Herein, these means comprise a sleeve-like member 80 made of sheet metal and adapted to be snapped releasably over the rear end portion of the right track 40R. The sleeve 80 includes an outer web 84 (FIG. 15) and inwardly projecting upper and lower flanges 85 and 86, these lying against the web 47R and the flanges 45R and 46R, respectively, of the track 40R. A lip 87 is formed integrally with and depends from the inner edge of the upper flange 85 and engages the inner side of the roller 66R. This confines the roller 66R laterally within the track 40R and restricts lateral movement of the adaptor 60R. A tongue 90 (FIG. 15) on the rear end of the sleeve 80 is inserted tightly into the right bracket 41 to prevent the sleeve from moving back and forth along the rail 40R.

From the foregoing, it will be apparent that the present invention brings to the art a new concept in which the same rail 30 and the same track 40 may be used in either a two-component system or in a three-component system. Thus, the manufacturer of the components need not make different types of rail and track components for the different systems nor does the cabinet maker need stock different types of rail or track components. The adaptor 60 is usable in three-component systems having drawers ranging in length from 16 inches to 22 inches. In a 16 inch drawer, the adaptor travels a fixed distance of four inches rather than one-half the distance the drawer opens, as occurs with the intermediate member in many conventional three-component systems. In longer drawers, the adaptor travels a distance of four inches plus the difference between the length of the drawer and 16 inches. Only one type of adaptor need be made and stocked for use with drawers having lengths of 16, 18, 20 and 22 inches and thus there is no need to make and stock intermediate members of four different lengths. While the three-component system most desirably uses the sleeve 80 in connection with the right adaptor 60R, only one length of sleeve is required for 16 to 22 inch drawers.

I claim:

1. A system for supporting a drawer in a cabinet for back and forth horizontal movement between a fully closed position in which the rear of the drawer is located adjacent the rear of the cabinet and a fully extended open position in which the rear of the drawer is located in very close proximity to the front of the cabinet, said system comprising an elongated rail secured to the drawer and extending along one side thereof, an elongated track secured to the cabinet and spaced above said rail, and an adaptor located between said rail and said track and adapted to coact with the rail and the track to support said drawer for movement toward and away from said closed position, a first roller rotatably supported on the rear end portion of said rail and positioned to ride along said adaptor, a second roller rotatably supported on the front end portion of said adaptor and positioned to support said rail as said first roller rides along said adaptor, a third roller rotatably supported on the rear end portion of said adaptor, a fourth roller rotatably supported on said adaptor between said front and rear end portions thereof and between said second and third rollers, said third and fourth rollers beinq at the same elevation and being positioned to ride along said track, and a fifth roller rotatably supported on the front end portion of said track.

2. A system as defined in claim 1 in which said third and fourth rollers support said adaptor to move forwardly with said drawer and along said track when said drawer is initially moved from said closed position, and means on said adaptor and engaging said fifth roller to stop further forward movement of said adaptor after said drawer has been moved forwardly a predetermined distance from said closed position.

3. A system as defined in claim 2 in which said means comprise a tab projecting laterally from said adaptor and toward said track and positioned to bump against said fifth roller to stop said further forward movement of said adaptor.

4. A system as defined in claim 2 further including a cup telescoped over said fifth roller and engageable with the side of the drawer to limit lateral movement of the drawer.

5. A system as defined in claim 2 further including snubber means carried by said drawer and coacting with said fifth roller for releasably holding said drawer in said fully closed position.

6. A system for supporting a drawer in a cabinet for back and forth horizontal movement between a fully closed position in which the rear of the drawer is located adjacent the rear of the cabinet and a fully extended open position in which the rear of the drawer is located forwardly of the front of the cabinet, said system comprising an elongated rail secured to the drawer and extending along one side thereof, an elongated track secured to said cabinet and spaced above said rail, and an adaptor located between said rail and said track and adapted to coact with the rail and the track to support said drawer for movement toward and away from said closed position, a first roller rotatably supported on the rear end of said rail and engageable with said adaptor, a second roller rotatably supported on the front end portion of said adaptor and engageable with said rail, a third roller rotatably supported on the rear end portion of said adaptor and engageable with said track, a fourth roller rotatably supported on said adaptor between the front and rear end portions of said adaptor and positioned to engage said track, means interconnecting said rail and said adaptor for forward movement in unison when said drawer is first moved from said closed position toward said open position, said third and fourth rollers beinq at the same elevation and riding along said track during forward movement of said adaptor, a fifth roller rotatably supported on the forward end of said track and operable to stop forward movement of said adaptor after said drawer has been moved a predetermined distance from said closed position, said interconnecting means releasing said rail for further forward movement independently of said adaptor when forward movement of said adaptor is stopped by said fifth roller, said first roller riding along said adaptor during said further forward movement of said rail, and said rail riding on said second roller during said further forward movement of said rail.

7. A system as defined in claim 6 further including snubber means carried by said drawer and coacting with said fifth roller for releasably holding said drawer in said fully closed position.

8. A system as defined in claim 7 in which said snubber means comprise a block made of resiliently yieldable material adhesively bonded to said one side of said drawer at a location above the forward end portion of said rail, and a bumper formed integrally with and projecting upwardly from said block and engaging the rear side of said fifth roller when said drawer is in said fully closed position.

9. A system as defined in claim 6 in which said track comprises an upright web and further comprises upper and lower flanges formed integrally with the upper and lower ends, respectively, of said web and projecting inwardly from said web toward said one side of said drawer, and a member formed separately of and attached releasably to said track and defining a lip projecting downwardly from said upper flange, said lip being engageable with said second roller to confine such roller laterally in said track.

10. A system as defined in claim 9 in which said member includes a web and upper and lower flanges which lie against the web and the upper and lower flanges, respectively, of said track, said lip being formed integrally with and depending from the upper flange of said member.

* * * * *